US008573760B2

(12) United States Patent
Hori et al.

(10) Patent No.: US 8,573,760 B2
(45) Date of Patent: Nov. 5, 2013

(54) LIQUID EJECTING APPARATUS

(75) Inventors: Kazuhito Hori, Azumino (JP); Toshio Kumagai, Shiojiri (JP); Kaoru Koike, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/370,156

(22) Filed: Feb. 9, 2012

(65) Prior Publication Data

US 2012/0212550 A1 Aug. 23, 2012

(30) Foreign Application Priority Data

Feb. 21, 2011 (JP) ..... 2011-034886

(51) Int. Cl.
*B41J 2/18* (2006.01)
*B41J 2/17* (2006.01)
*B41J 2/175* (2006.01)

(52) U.S. Cl.
USPC ..... 347/89; 347/84; 347/85

(58) Field of Classification Search
USPC ..... 347/84, 85, 89
See application file for complete search history.

(56) References Cited

U.S. PATENT DOCUMENTS

2006/0209140 A1* 9/2006 Nagai ..... 347/85
2009/0160887 A1 6/2009 Hamazaki et al.
2010/0053279 A1 3/2010 Tamaki

FOREIGN PATENT DOCUMENTS

EP 0916502 5/1999
JP 2000-327964 11/2000
JP 2002-166572 6/2002
JP 2004-098475 4/2004

OTHER PUBLICATIONS

Extended European Search Report dated May 29, 2012 for European Patent Application No. 12155938.9.

* cited by examiner

*Primary Examiner* — Jannelle M Lebron
(74) *Attorney, Agent, or Firm* — Workman Nydegger

(57) ABSTRACT

An outgoing path port and a returning path port of a circulation path are at a position that is lower than a printing head. The outgoing path port and a discharge port of a discharge path are at a position that is lower than the returning path port. When ink droplets are ejected from the printing head, ink is pumped from a main tank to a sub tank using a supply pump, and ink is pumped from the outgoing path port to the printing head using a circulation pump with an opening and closing valve open and an opening and closing valve closed. In a case where discharge of ink in the sub tank and a circulation path is instructed before replacing of an ink unit, ink is pumped from the outgoing path port to a junction side using the circulation pump with both of the valves open.

4 Claims, 3 Drawing Sheets

LIQUID EJECTING APPARATUS

This application claims the benefit of Japanese Application No. 2011-034886, filed Feb. 21, 2011, all of which are hereby incorporated by reference.

BACKGROUND

1. Technical Field

The present invention relates to a liquid ejecting apparatus.

2. Related Art

In the past, as this type of liquid ejecting apparatus, it is conceivable to provide a liquid ejecting apparatus which is provided with a recording head which has an input port and an output port for ink circulation and ejecting ink. The apparatus also includes an ink tank which stores ink, a sub tank which temporarily stores ink which is supplied from the ink tank, an ink circulation path which includes a supply path which connects the sub tank and the input port of the recording head and a return path which connects the output port of the recording head and the sub tank, a pump which is provided in the supply path, a valve which is provided in the return path, a recovery tub which performs capping of the recording head when not recording and receives ink which is ejected during recovery, an ink retrieval path for returning ink in the recovery tub to the sub tank, a discharge path which is connected to the return path of the ink circulation path, and a discharge valve which is provided in the discharge path (for example, JP-A-2004-98475). In this apparatus, when an ink discharge process is performed, the ink in the sub tank is discharged to a liquid water container via a discharge port due to a discharge valve being in an open state.

In the liquid ejecting apparatus such as this, when the main tank or the sub tank are replaced or the like, there are cases where it is desirable to discharge not only ink in the sub tank, but also ink in the circulation path such as, for example, when the ink which is used in the main tank and the sub tank is changed to ink where the color or type is different from that currently used. In addition, in the liquid ejecting apparatus such as this, there is an issue with regard to, when ink is ejected from the recording head, the ejecting being able to be performed more appropriately.

SUMMARY

An advantage of some aspects of the invention is that a liquid ejecting apparatus is able to discharge not only liquid in a storage section, but also liquid in a circulation path as required and is able to more appropriately perform ejection of liquid from an ejecting head.

The liquid ejecting apparatus of the invention adopts a method below in order to achieve the advantage described above.

According to an aspect of the invention, there is provided a liquid ejecting apparatus which ejects a liquid from an ejecting head and is provided with a storage section which stores the liquid, a circulation path which is configured to include the ejecting head and where an outgoing path port (which is one opening edge portion) is disposed in the storage section to be lower than the ejecting head, and where a returning path port (which is the other opening edge portion) is disposed in the storage section to be lower than the ejecting head and in a position which is higher than the outgoing path port, a pumping unit which is provided closer to the outgoing path port side than the ejecting head in the circulation path and is able to pump the liquid, a discharge path which is connected to the circulation path closer to the returning path port side than the ejecting head in the circulation path and where a discharge port (which is an opening edge portion) is disposed in a position which is lower than the returning path port, and an opening and closing valve which is provided in the discharge path and is able to open and close.

According to the aspect of the invention, the circulation path which is configured to include the ejecting head and where the outgoing path port which is one of the opening edge portions may be disposed in the storage section to be lower than the ejecting head and the returning path port which is the other of the opening edge portions is disposed in the storage section to be lower than the ejecting head in a position which is higher than the outgoing path port, the pumping unit which is provided further to the outgoing path port side than the ejecting head in the circulation path and is able to pump the liquid, the discharge path which is connected to the circulation path further to the returning path port side than the ejecting head in the circulation path and where a discharge port which is an opening edge portion is disposed in a position which is lower than the returning path port, and the opening and closing valve which is provided in the discharge path and is able to open and close. Accordingly, since the returning path port and the discharge port are lower than the ejecting head and the discharge port is disposed at a position which is lower than the returning path port, the liquid flows from the returning path port side to a communication position (referred to below as a junction) side with the discharge path and is discharged from the discharge port via the discharge path due to siphoning principles in a case where the opening and closing valve is open. In addition, due to the pumping unit and the opening and closing valve being controlled so as to pump the liquid from the outgoing path port side to the ejecting head side in a state where the opening and closing valve is open, the liquid is pumped from the outgoing path port side to the junction side and is discharged from the discharge port via the discharge path when the discharge of the liquid in the storage section and the circulation path is instructed or the like. Accordingly, due to the liquid being pumped from the outgoing path port side to the junction side using the pumping unit and the liquid flowing from the returning path port side to the junction side using siphoning principles, it is possible to discharge the liquid in the storage section and the liquid in the circulation path from the discharge port. In addition, when the liquid is ejected from the ejecting head, due to the pumping unit being controlled so that the liquid in the storage section enters the circulation path from the outgoing path port which is disposed in a position which is lower than the returning path port and returns from the returning path port to the storage section via a printing head, it is possible to control so that bubbles (gas) are mixed in from the outgoing port path to the circulation path and it is possible that the arrival of the bubbles at the recording head is suppressed. Due to this, it is possible to more appropriately perform ejecting of the liquid from the ejecting head. Here, it is possible for the pumping unit to be a gear pump.

In the liquid ejecting apparatus, the discharge path may be formed with a diameter which is larger than the circulation path. By doing this, when the liquid in the storage unit and the circulation path is discharged from the discharge port using the method described above, it is possible for the liquid which is pumped from the outgoing path port side to the communication position (junction) side with the discharge path using the pumping unit and the liquid which flows from the returning path port side to the junction side using the siphoning principles to be combined at the junction and to be discharged from the discharge port via the discharge path more smoothly.

In addition, in the liquid ejecting apparatus, a discharge control unit may be provided which executes discharge control where the pumping unit and the opening and closing valve are controlled so that the liquid is pumped from the outgoing path port side to the ejecting head side in a state where the opening and closing value is open when the discharge of the liquid in the storage section and the circulation path is instructed before the replacement of or after the replacement of the storage section. By doing this, it is possible to discharge the liquid in the storage section and the circulation path from the discharge port as described above. In the liquid ejecting apparatus, the discharge control unit may be a unit which controls the pumping unit so that the flow amount of the liquid which flows from the returning path port side to the communication position (junction) side with the discharge path and the flow amount of the liquid which is pumped from the outgoing path port side to the communication position are equal. By doing this, it is possible for liquid which flows from the returning path port side to the junction and the liquid which is pumped from the outgoing path port side to the junction are discharged from the discharge port more smoothly. In addition, in the liquid ejecting apparatus, a pressurizing unit which pressurizes the storage section may be provided and the discharge control unit may be a unit which controls the pressurizing unit so that the storage section is pressurized in addition to the control of the pumping unit and the opening and closing valve. By doing this, a large flow amount of the liquid which enters the circulation path from the returning path port and flows to the junction is possible and it is possible for the ink in the storage section to be more swiftly discharged from the discharge port.

Alternatively, in the liquid ejecting apparatus, the storage section may be a sub storage section which temporarily stores the liquid and a main storage section may be provided which stores the liquid, an inter-tank connecting path where a supply source port which is one opening edge portion is disposed in the main storage section and a supply port which is the other opening edge portion is disposed in the sub storage section, and a second pumping unit which is provided in the inter-tank connecting path and is able to pump the liquid. In the case of this configuration, due to the pumping unit and the opening and closing valve being controlled so as to pump the liquid from the outgoing path port side to the ejecting head side in a state where the opening and closing valve is open, it is possible for the liquid in the sub storage section and the circulation path to be discharged.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
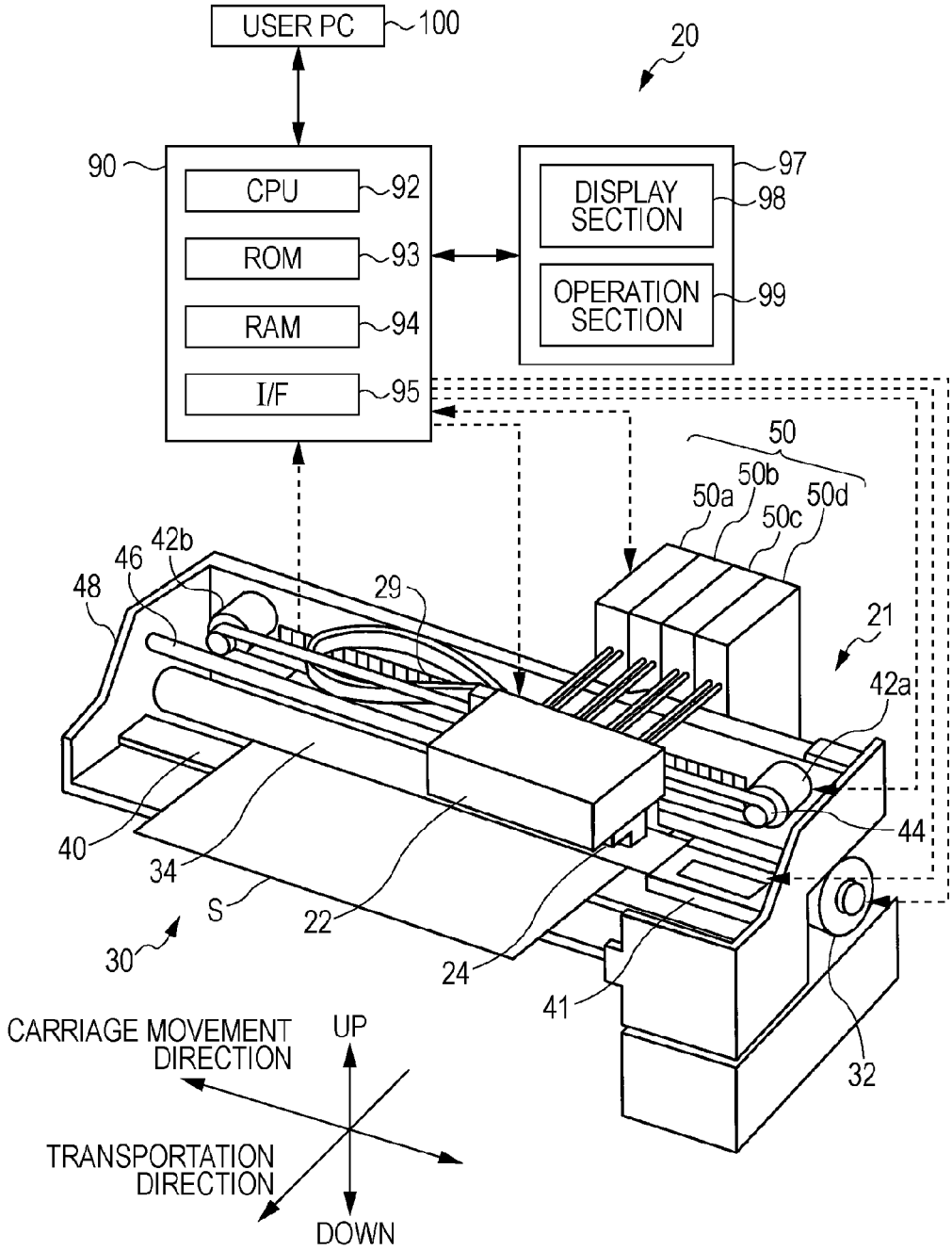
FIG. 1 is a configuration diagram illustrating an outline of a configuration of an ink jet printer.
Figure 2:
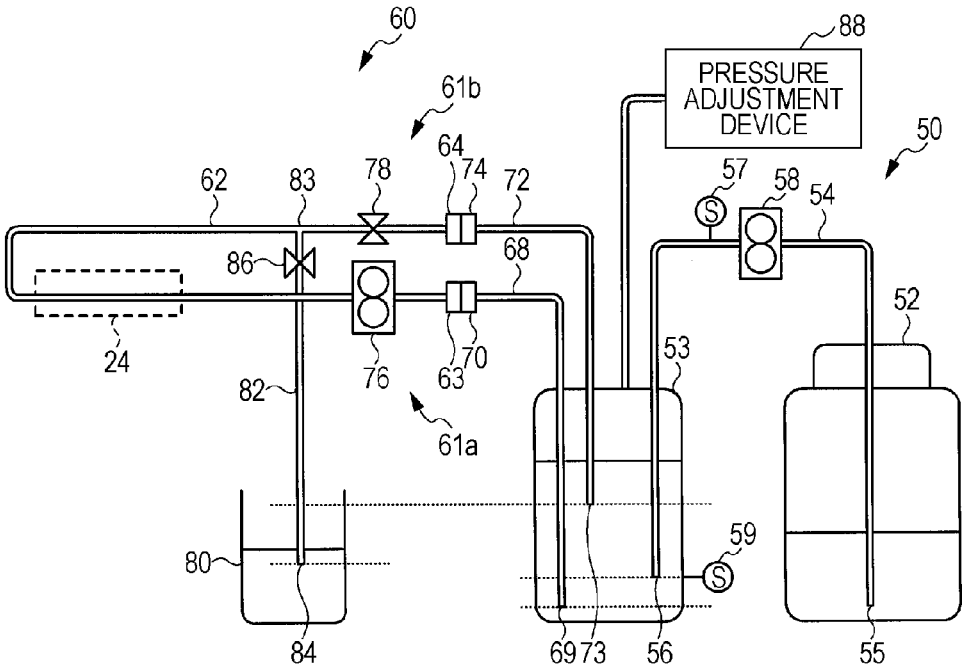
FIG. 2 is a configuration diagram illustrating an outline of a configuration of an ink circulation system.

Next, an embodiment of the invention will be described using the diagrams. FIG. 1 is a configuration diagram illustrating an outline of a configuration of an ink jet printer 20 which is an embodiment of the invention. FIG. 2 is a configuration diagram illustrating an outline of a configuration of an ink circulation system 50. As shown in FIG. 1, the ink jet printer 20 of the embodiment is provided with a paper feeding mechanism 30 which transports a recording paper S on a platen 40 towards the viewer in the diagrammed view by driving a paper feeding roller 34 using a driving motor 32, a printer mechanism 21 which performs printing by ejecting ink droplets from a printing head 24 onto the recording paper S which has been transported by the paper feeding mechanism 30, a capping device 41 which is formed on the right side of the platen 40 in the diagram and performs capping by covering the printing head 24 when not actively printing, a controller 90 which controls the entire apparatus, and an operating panel 97 which has a display section 98 for notifying a user of various information and an operation section 99 where the user inputs various instructions.

The printer mechanism 21 is provided with a carriage 22 which reciprocates left and right along a guide 46 responsive to a carriage belt 44, which spans between a carriage motor 42*a* (which is attached to the right side of a mechanical frame 48) and a driven roller 42*b* (which is attached to the left side of the mechanical frame 48 and is driven by the carriage motor 42*a*), a printing head 24 which is provided at a lower portion of the carriage 22 and which ejects ink droplets, and ink circulation systems 50*a* to 50*d* (collectively referred to below as an ink circulation system 50) which respectively circulate ink of cyan (C), magenta (M), yellow (Y), and black (K) via each printing head 24. Here, a linear encoder 29 detects the position of the carriage 22, and is disposed on a rear surface of the carriage 22. The position of the carriage 22 is managed using the linear encoder 29. In addition, in the embodiment, the ink of cyan (C), magenta (M), yellow (Y), and black (K) uses ultraviolet curing ink which cures quickly using irradiation of ultraviolet rays.

The printing head 24 ejects the various colors of ink from a plurality of nozzles which are provided on a lower surface of the printing head 24 using a method in which the ink is pressurized by a built-in piezoelectric element being deformed due to a voltage being applied to the piezoelectric element. Here, the printing head 24 may adopt a method in which the ink is pressurized by bubbles that are generated by a voltage being applied to a heat resistant body (for example, a heater or the like) and the ink being heated. In addition to the ink ejection nozzles that eject ink droplets that are for ejecting the various colors of ink (ultraviolet curing ink) as ink droplets, the printing head 24 also includes a solidification promotion nozzle for irradiating ultraviolet rays for promoting the solidification of the ink. It is possible to quickly cure the ink by irradiating ultraviolet rays from the solidification promotion nozzle towards the ink droplets which have been ejected from the ink ejection nozzles.

As shown in FIG. 2, the ink circulation system 50 is provided with a main tank 52 which stores the ink, a sub tank 53 which temporarily stores the ink, a supply path 54 where one opening edge portion (referred to below as a supply source port) 55 is disposed in the main tank 52 and the other opening edge portion (referred to below as a supply port) 56 is disposed in the sub tank 53, and a supply pump 58 which is provided in the supply path 54 and is able to pump liquid. A circulation path 60 is configured to include the printing head 24 and where one opening edge portion (referred to below as an outgoing path port) 69 and the other opening edge portion (referred to below as a returning path port) 73 are both disposed in the sub tank 53, a circulation pump 76 which is provided further towards the outgoing path port 69 side than the printing head 24 in the circulation path 60 (defining an outgoing path 61*a*) and is able to pump liquid, an opening and closing valve 78 which is provided further towards the returning path port 73 side than the printing head 24 in the circulation path 60 (defining a returning path 61*b*) and is able to open and close, a waste liquid tank 80, a discharge path 82 which branches at a junction 83 in the circulation path 60 between the printing head 24 and the opening and closing valve 78 and where an opening edge section (referred to below as discharge port) 84 is disposed in the waste liquid tank 80, an opening and closing valve 86 which is provided in the discharge path 82 and is able to open and close. A pressure adjustment device 88 is able to open the sub tank 53 to the atmosphere and pressurize in the sub tank 53. Here, in the embodiment, since ultraviolet curing ink is used, the main tank 52, the sub tank 53, the waste liquid tank 80, the supply pump 58, the circulation pump 76, and the like are formed using a metal such as stainless steel as a material which ultraviolet rays do not pass through. Likewise, the supply path 54, the circulation path 60, and the like are formed using colored polypropylene and the like as a material which ultraviolet rays do not pass through.

The outgoing path port 69 and the returning path port 73 of the circulation path 60 and the discharge port 84 of the discharge path 82 are each disposed in a position which is lower than the printing head 24 and the junction 83. In addition, the returning path port 73 of the circulation path 60 is positioned to be higher than the supply port 56 of the supply path 54, which is likewise positioned to be higher than the outgoing path port 69 of the circulation path 60. Furthermore, the discharge path 82 is formed to have a diameter which is larger than the diameter of the circulation path 60. As an example, the cross-sectional area of the discharge path 82 may be 1.5 times or double that of the circulation path 60).

The circulation path 60 is configured with an intermediate section 62 which includes the circulation pump 76, the printing head 24, and the opening and closing valve 78, and an outgoing path port section 68 which includes the outgoing path port 69. The circulation path 60 also includes a returning path port section 72 which includes the returning path port 73, a connector 63 on the circulation pump 76 side of the intermediate section 62 with a connector 70 of the outgoing path port section 68 connected thereto, and a connector 64 on the opening and closing valve 78 side of the intermediate section 62 and with a connector 74 of the returning path port section 72 connected thereto. Accordingly, when a user replaces a section to the right side of the connectors 70 and 74 in FIG. 2 (the section which includes the main tank 52, the sub tank 53, the supply path 54, the supply pump 58, and the outgoing path port section 68 and the returning path port section 72 of the circulation path 60 is referred to below as an ink unit), it is possible to replace the ink unit without removing the outgoing path port section 68 or the returning path port section 72 from the sub tank 53. This is because this may be accomplished by releasing the connection of the connector 70 of the outgoing path port section 68 with from the connector 63 of the intermediate section 62 is and by releasing the connection of the connector 74 of the returning path port section 72 and the connector 64 of the intermediate section 62 is released. Furthermore, after the replacing of the ink unit, the connector 70 of the outgoing path port section 68 would be connected to the connector 63 of the intermediate section 62 and the connector 74 of the returning path port section 72 would be connected to the connector 64 of the intermediate section 62, The supply pump 58 is configured as a gear pump, and it is possible to pump the ink from the main tank 52 side to the sub tank 53 side by being rotated (referred to below as being rotated in a normal rotation direction) in a predetermined direction (for example, clockwise) and it is possible to pump the ink from the sub tank 53 side to the main tank 52 side by being rotated (referred to below as being rotated in a reverse rotation direction) in a direction which is opposite to the predetermined direction (for example, counterclockwise). Using a configuration such as this, it is possible for the path that supplies the ink from the main tank 52 side to the sub tank 53 side and the path that returns the ink from the sub tank 53 side to the main tank 52 side to be the same (the supply path 54), thereby simplifying the configuration.

The circulation pump 76 is configured as a gear pump in the same manner as the supply pump 58, and it is possible to pump the ink from the outgoing path port 69 side to the printing head 24 side by being rotated (referred to below as being rotated in a normal rotation direction) in a predetermined direction (for example, clockwise) and it is possible to pump the ink from the printing head 24 side to the outgoing path port 69 side by being rotated (referred to below as being rotated in a reverse rotation direction) in a direction which is opposite to the predetermined direction (for example, counterclockwise). Here, the circulation pump 76 is configured so that the circulation path 60 is not closed when the driving is stopped.

The controller 90 is configured as a microprocessor which is centered around a CPU 92 as shown in FIG. 1 and is provided with a ROM 93 which stores various processing programs, a RAM 94 which temporarily stores data, an interface (I/F) 95 which performs exchange of information with external devices, and an input and output port which is not shown. A printing buffer region is provided in the RAM 94. Print data (which is sent from a user PC 100 via the I/F 95) is stored in the printing buffer region. In the controller 90, in addition to a position detection signal from the linear encoder 29, a detection signal from an ink detection sensor 57 (which is configured as a photosensor or the like and detects the presence of ink at a predetermined position in the supply path 56 (for example, slightly further to the supply port 56 side than the supply pump 58 or the like)), a detection signal from an ink detection sensor 59 (which is configured as a photosensor or the like and detects the presence of ink at a position at the supply port 56 of the supply path 54), an operation signal from the operation section 99 of the operation panel 97, and the like are input via the input port. A print job or the like is input from the user PC 100 via the I/F 95. In addition, from the controller 90, in addition to a control signal to the printing head 24, a control signal to the driving motor 32 and the carriage motor 42*a*, a control signal to the supply pump 58 and the circulation pump 76, a control signal to the capping device 41, a control signal to the opening and closing valve 78 and the opening and closing valve 86, a control signal to the pressurizing device 88, a display control signal to the display section 98 of the operation panel 97, and the like are output via the output port. Printing status information and the like are output to the user PC 100 via the I/F 95.

In the ink jet printer 20 of the embodiment which is configured in this manner, in a case where printing is performed on a recording paper S by ink droplets being ejected from the printing head 24, the ink in the main tank 52 is supplied to the sub tank 53, the ink in the sub tank 53 is supplied to the printing head 24 from the outgoing path port 69, and a portion thereof is returned to the sub tank 53 from the returning path port 73 side via the printing head 24 by the supply pump 58. In this case, the circulation pump 76, the opening and closing valve 78, and the opening and closing valve 86 are controlled so that the supply pump 58 and the circulation pump 76 are both rotated in a normal rotation direction in a state where the opening and closing valve 78 is open and the opening and closing valve 86 is closed. In the embodiment, the bubbles (air) entering into the circulation path 60 from the outgoing path port 69 and arriving at the printing head 24 are suppressed when printing is performed from the outgoing path port 69 of the circulation path 60 being in a lower position than the returning path port 73 of the circulation path 60 and the supply port 56 of the supply path 54 as described above. Due to this, it is possible to more appropriately perform printing. Here, as possible sources for the bubbles that are present in the sub tank 53, there are bubbles which are included in the ink which is pumped to the sub tank 53 from the main tank 52 via the supply path 54, bubbles which are included in the ink which is released into the sub tank 53 from the returning path port 73 of the circulation path 60, and the like.

Figure 3:
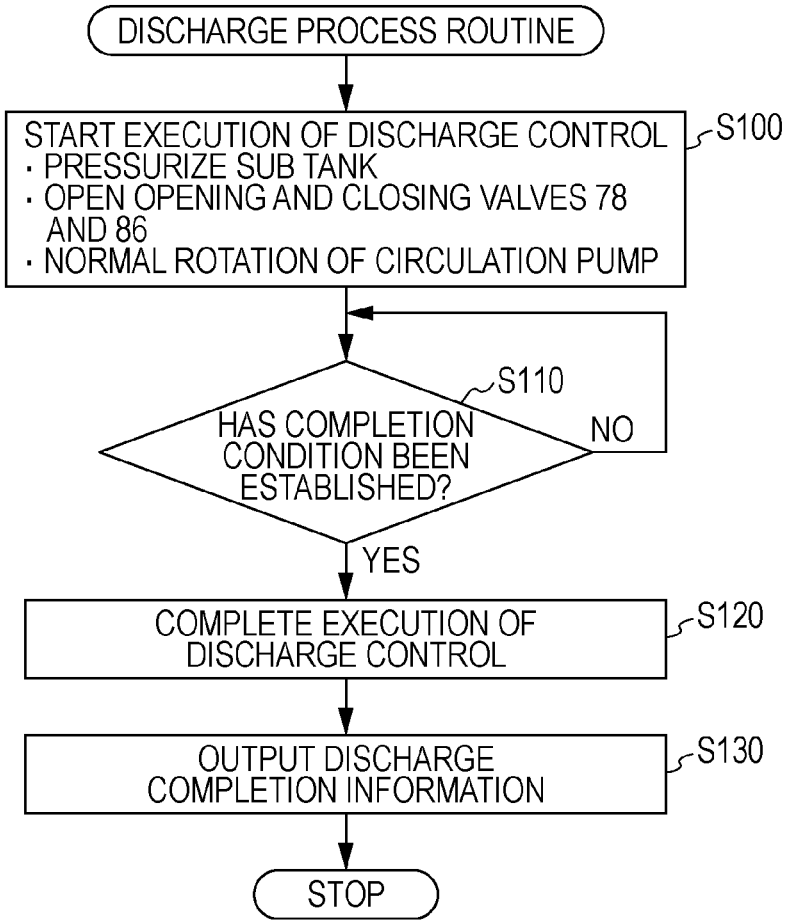
FIG. 3 is a flowchart illustrating one example of a discharge process routine.

Next, the operation will be described of the ink jet printer 20 of the embodiment which is configured in this manner. In particular, the operation will be described when the ink in the sub tank 53 and the circulation path 60 is discharged to the liquid waste tank 80 before replacing the ink unit. FIG. 3 is a flowchart illustrating one example of a discharge process routine which is executed by the controller 90. The routine is executed when the discharging of the ink in the sub tank 53 and the circulation path 60 to the waste liquid tank 80 is instructed due to interaction with the operation section 99 of the operational panel 97 by the user such as before replacing of the ink unit. Here, as when the ink unit is replaced, when the ink which is used in the ink circulation system 50 is changed to an ink with a color or type which is different to that currently used, for example, when the arrangement order in the ink circulation systems 50*a* to 50*d* (the order from the left in FIG. 1) is changed from the order of yellow (Y), magenta (M), cyan (C), and black (K) to the order of black (K), cyan (C), magenta (M), and yellow (Y), when the ink in the ink circulation system 50 is changed to a new color of ink (colors other than cyan (C), magenta (M), yellow (Y), and black (K)), when the ink in the ink circulation system 50 is changed to a water soluble ink or a solvent ink from the ultraviolet curing ink, and the like can be considered. Here, in a case where the ink in the main tank 52 runs out or the like, only the main tank 52 may be replaced or ink may be filled into the main tank 52, or the ink unit may be replaced.

When the discharge process routine is executed, the controller 90 starts the execution of the discharge control where the circulation pump 76, the opening and closing valve 78, the opening and closing valve 86, and the pressurizing device 88 are controlled so that the sub tank 53 is pressurized using the pressurizing device 88. In this case, the opening and closing valve 78 and the opening and closing valve 86 are both opened, and the circulation pump 76 is rotated in the normal rotation direction (step S100). The execution thereof continues until a completion condition of the discharge control is established (steps S110 and S120). Here, as the completion condition of the discharge control, it is possible to use a condition where a predetermined period (which is set as a period which is necessary for the discharging of the ink in the sub tank 53 and the circulation path 60) has elapsed, a condition where ink is no longer discharged from the discharge port 84, or the like. Since the returning path port 73 of the circulation path 60 and the discharge port 84 of the discharge path 82 are each lower than both the printing head 24 and the junction 83, and since the discharge port 84 is disposed in a position which is lower than the returning path port 73 as described above, when the opening and closing valve 86 is opened, the ink flows from the returning path port 73 side to the junction 83 side due to the siphoning principles and is further discharged from the discharge port 84 to the waste liquid tank 80 via the discharge path 82. At this time, while the liquid surface of the ink in the sub tank 53 is the height of the returning path port 73 or higher, the ink in the sub tank 53 enters the circulation path 60 from the returning path port 73 and flows to the junction 83 side, and after the liquid surface of the ink in the sub tank 53 becomes lower than the returning path port 73, air enters the circulation path 60 from the returning path port 73 and flows to the junction 83 side. In addition, the ink flows from the outgoing path port 69 side to the junction 83 side due to the rotation of the circulation pump 76 in the normal rotation direction, and the ink is further discharged from the discharge port 84 to the waste liquid tank 80 via the discharge path 82. Accordingly, it is possible for the ink in the sub tank 53 and the circulation path 60 to be discharged to the waste liquid tank 80 since the ink is pumped from the outgoing path port 69 side to the junction 83 side using the circulation pump 76 and the ink flows from the returning path port 73 side to the junction 83 side using siphoning principles, and both are discharged from the discharge port 84 via the discharge path 82 by being combined at the junction 83. Furthermore, in the embodiment, due to the discharge path 82 being formed with a diameter which is larger than that of the circulation path 60, it is possible for the ink (which is pumped from the outgoing path port 69 side to the junction 83 side) and the ink (which flows from the returning path port 73 side to the junction 83 side) to be more smoothly discharged from the discharge port 84 to the waste liquid tank 80 via the discharge path 82 by being combined at the junction 83. In addition, due to the pressurizing of the sub tank 53 using the pressurizing device 88, it is possible to increase the flow amount of the ink which flows from the returning path port 73 side to the junction 83 side and it is possible to discharge the ink from the sub tank 53 to the waste liquid tank 80 more swiftly. In addition, in the embodiment, the circulation pump 76 is controlled so that the circulation pump 76 rotates in the normal direction with a balance rotation number where the flow amount in the reverse direction which is the flow amount of the ink which flows from the returning path port 73 side to the junction 83 side and the flow amount in the normal direction which is the flow amount of the ink which is pumped from the outgoing path port 69 side to the junction 83 side are equal. Due to this, it is possible for the ink (which flows from the returning path port 73 side to the junction 83 side) and the ink (which is pumped from the outgoing path port 69 side to the junction 83 side) to be more smoothly discharged from the discharge port 84 via the discharge path 82 by being combined at the junction 83. Here, for example, it is possible for the flow amount in the reverse direction to be detected by a flow amount sensor or the like being attached further to the returning path port 73 side than the opening and closing valve 78 in the returning path 61*b* or to be estimated based on a detection value by a liquid surface sensor which detects the liquid surface of the ink in the sub tank 53, a pressure sensor which detects the pressure in the sub tank 53, or the like being attached to the sub tank 53. In addition, it is possible for the balance rotation number to be set by such as the flow amount in the reverse direction being applied as the flow amount in the normal direction with regard to a relationship between the number of rotations of the circulation pump 76 and the flow amount in the normal direction.

When the execution of the discharge control has been completed in this manner, discharge completion information (e.g., information which shows that the execution of the discharge control has been completed) is displayed in the display section 98 of the operation panel (step 5130) and the discharge process routine is completed. It is sufficient if the user which confirms the display releases the connection of the connector 70 of the outgoing path port section 68 and the connector 63 of the intermediate section 62 and releases the connection of the connector 74 of the returning path port section 72 and the connector 64 of the intermediate section 62, and in the ink unit after the replacing, connects the connector 70 of the outgoing path port section 68 to the connector 63 of the intermediate section 62 and connects the connector 74 of the returning path port section 72 to the connector 64 of the intermediate section 62. Accordingly, it is possible to easily perform replacement of the ink unit.

Here, the correspondence relationship of the constituent elements of the embodiment and the constituent elements of the invention will be made clear. The printing head 24 of the embodiment is equivalent to the "ejecting head" of the invention, the sub tank 53 is equivalent to the "storage section", the circulation path 60 is equivalent to the "circulation path", the circulation pump 76 is equivalent to the "pressurizing unit", the discharge path 82 is equivalent to the "discharge path", and the opening and closing valve 86 is equivalent to the "opening and closing valve".

According to the ink jet printer 20 of the embodiment described above, when the outgoing path port 69 and the returning path port 73 of the circulation path 60 are at positions which are each lower than the printing head 24, and the discharge port 84 of the discharge path 82 is at a position lower than the returning path port 73 of the circulation path 60, and the discharge of the ink in the sub tank 53 and the circulation path 60 to the waste liquid tank 80 is instructed before replacing of the ink unit, it is possible that the ink in the sub tank 53 and the circulation path 60 is discharged to the waste liquid tank 80 since the ink which is pumped from the outgoing path port 69 side to the junction 83 side using the circulation pump 76 and the ink which flows from the returning path port 73 side to the junction 83 side using the siphoning principles are discharged from the discharge port 84 via the discharge path 82 by being combined at the junction 83 due to the circulation pump 76, the opening and closing valve 78, and the opening and closing valve 86 being controlled so that ink is pumped from the outgoing path port 69 side to the junction 83 side in a state where the opening and closing valve 78 and the opening and closing valve 86 are both opened. Furthermore, according to the ink jet printer 20 of the embodiment, it is possible to discharge the ink in the sub tank 53 and the circulation path 60 to the waste liquid tank 80 more smoothly and swiftly due to the discharge path 82 being formed with a diameter which is larger than that of the circulation path 60, the sub tank 53 being pressurized using the pressurizing device 88 when the ink is being discharged, and the circulation pump 76 being controlled so that the circulation pump 76 is rotated in the normal rotation direction with a number of rotations where the flow amount in the reverse direction which is the flow amount of the ink which flows from the returning path port 73 side to the junction 83 side and the flow amount in the normal direction which is the flow amount of the ink which is pumped from the outgoing path port 69 side to the junction 83 side are equal when the ink is being discharged.

In addition, according to the ink jet printer 20 of the embodiment, in a case where printing is performed on the recording paper S by ink droplets being ejected from the printing head 24 with the outgoing path port 69 of the circulation path 60 being at a position which is lower than the returning path port 73, the ink in the main tank 52 is supplied to the sub tank 53, the ink in the sub tank 53 is supplied to the printing head 24 from the outgoing path port 69 side, and a portion thereof is returned to the sub tank 53 from the returning path port 73 side via the printing head 24 by the supply pump 58, the circulation pump 76, the opening and closing valve 78, and the opening and closing valve 86 being controlled so that the supply pump 58 and the circulation pump 76 are both rotated in the normal rotation direction in a state where the opening and closing valve 78 is open and the opening and closing valve 86 is closed. Thus, it is possible to suppress the bubbles (air) entering into the circulation path 60 from the outgoing path port 69 and arriving at the printing head 24.

Here, the invention is not limited to the embodiment described above and it is needless to say that various modifications are possible as long as being within the technical scope of the invention.

In the embodiment described above, the ink in the sub tank 53 and the circulation path 60 is discharged to the waste liquid tank 80 by the executing of the discharge control before the replacing of the ink unit, but the ink of the sub tank 53 and the circulation path 60 may be discharged to the waste liquid tank 80 by the executing of the discharge control after the replacing of the ink unit, and at other times. For example, the ink of the sub tank 53 and the circulation path 60 may be discharged to the waste liquid tank 80 by the executing of the discharge control such as when the system is activated after a predetermined period of time or more, where increased viscosity of the ink is estimated, has passed since the previous stopping of the system.

In the embodiment described above, the discharge path 82 is formed with a diameter which is larger than the circulation path 60, but may be formed with the same diameter.

In the embodiment described above, the circulation pump 76 is controlled so that the circulation pump 76 rotates in the normal direction with a balance rotation number where the flow amount of the ink which flows from the returning path port 73 side to the junction 83 side and the flow amount of the ink which is pumped from the outgoing path port 69 side to the junction 83 side are equal. However, the circulation pump 76 or the like may be controlled so as to rotate in the normal rotation direction a predetermined number of times which is determined in advance. Here, the predetermined number of times may be the same number of rotations when printing is performed by ink droplets being ejected from the printing head 24 or may be a number of rotations which is higher than this.

In the embodiment described above, the sub tank 53 is pressurized using the pressurizing device 88 as the discharge control, but the sub tank 53 may not be pressurized (held in a state of being open to the atmosphere). In this case, the sub tank 53 may be open to the atmosphere without the pressurizing device 88 being provided.

In the embodiment described above, the ink circulation system 50 is provided with the main tank 52, the sub tank 53, the supply path 54, the supply pump 58, the circulation path 60, the circulation pump 76, the opening and closing valve 78, the waste liquid tank 80, the discharge path 82, and the opening and closing valve 86, but the main tank 52, the supply path 54, and the supply pump 58 may not be provided.

In the embodiment described above, each of the constituent elements of the ink circulation system 50 are formed by a material which does not allow ultraviolet rays to pass, but may be formed by a material other than that which does not allow ultraviolet rays to pass in a case where the ink jet printer 20 is used with an arrangement where ultraviolet curing ink is not used.

In the embodiment described above, the supply pump 58 uses a gear pump, but any pump may be used as long as it is able to pump the ink from the main tank 52 side to the sub tank 53 side and it is able to pump the ink from the sub tank 53 side to the main tank 52 side, and for example, a tube pump or the like may be used. With regard to the circulation pump 76, a tube pump or the like may be used in the same manner.

In the embodiment described above, the circulation path 60 is able to separate the outgoing path port 68, the returning path port 72, and the intermediate section 62 by releasing the connection of the connector 63 of the intermediate section 62 and the connector 70 of the outgoing path port section 68, and by releasing the connector 64 of the intermediate section 62 and the connection of the connector 74 of the returning path port section 72, but may be formed in an integral manner without the connectors being provided. In this case, when the main tank 52 and the sub tank 53 are replaced together, instead of the ink unit which is a portion further on the right side of the connectors 70 and 74 in FIG. 2 being replaced, it is sufficient if the sub tank 53 is removed from the circulation path 60 and the main tank 52 and the sub tank 53 are replaced.

In the embodiment described above, the liquid ejecting apparatus of the invention is exemplified by the ink jet printer 20, but may be exemplified by a liquid ejecting apparatus which ejects a liquid other than ink, a fluid (dispersion solution) where particles of a function material are dispersed, a fluid such as a gel, or the like. For example, the liquid ejecting apparatus of the invention may be a liquid ejecting apparatus which ejects a liquid where an electrode material or a colorant, which is used in the manufacturing of liquid crystal displays, EL (electroluminescent) displays, surface emitting displays, or the like, is dispersed, a fluid ejecting apparatus which ejects a fluid where the same material is dispersed, or a liquid ejecting apparatus which is used as a precision pipette and ejects a liquid which is a sample. In addition, the liquid ejecting apparatus of the invention may be a liquid ejecting apparatus which ejects lubricating oil in a pin point manner onto precision machinery such as a watch or a camera, a liquid ejecting apparatus which ejects a transparent resin solution such as an ultraviolet curing resin onto a substrate in order to form a microscopic semispherical lens (optical lens) which is used in optical communication elements and the like, a liquid ejecting apparatus which ejects an etching liquid such as an acid or an alkali in order to perform etching of a substrate or the like, or a fluid ejecting apparatus which ejects a gel.

In the embodiment described above, the liquid ejecting apparatus of the invention is described by being applied to the ink jet printer 20, but is not limited to this and it is sufficient if it is a form of liquid ejecting apparatus which ejects liquid from an ejecting head, and for example, may be applied to an office equipment which is any of a facsimile device, a multifunctional device, or the like.

What is claimed is:

1. A liquid ejecting apparatus which ejects a liquid from an ejecting head, the apparatus comprising:

a storage section which stores the liquid;

a circulation path which is configured to include the ejecting head and where an outgoing path port, which is one opening edge portion, is disposed in the storage section to be lower than the ejecting head and a returning path port, which is the other opening edge portion, is disposed in the storage section to be lower than the ejecting head and in a position which is higher than the outgoing path port;

a pumping unit which is provided closer to the outgoing path port side than the ejecting head in the circulation path and is able to pump the liquid;

a discharge path which is connected to the circulation path closer to the returning path port side than the ejecting head in the circulation path and where a discharge port, which is one opening edge portion, is disposed in a position which is lower than the returning path port; and an opening and closing valve which is provided in the discharge path and is able to open and close, wherein the discharge path is formed with a diameter which is larger than that of the circulation path.

2. The liquid ejecting apparatus according to claim 1, further comprising:

a discharge control unit which executes discharge control where the pumping unit and the opening and closing valve are controlled so that the liquid is pumped from the outgoing path port side to the ejecting head side in a state where the opening and closing valve is open when discharge of the liquid in the storage section and the circulation path is instructed before the replacement of or after the replacement of the storage section.

3. The liquid ejecting apparatus according to claim 2, wherein the discharge control unit is a unit which controls the pumping unit so that the flow amount of the liquid which flows from the returning path port side to a communication position with the discharge path and the flow amount of the liquid which is pumped from the outgoing path port side to the communication position are equal.

4. The liquid ejecting apparatus according to claim 2, further comprising:

a pressurizing unit which pressurizes the storage section, wherein the discharge control unit is a unit which controls the pressurizing unit so that the storage section is pressurized in addition to the control of the pumping unit and the opening and closing valve.

* * * * *